US006116348A

United States Patent [19]

Drakin

[11] Patent Number: 6,116,348

[45] Date of Patent: Sep. 12, 2000

[54] METHOD AND APPARATUS FOR FIRE EXTINGUISHING

[75] Inventor: Nikolay Vasiljevich Drakin, Moskovskaya oblast, Russian Federation

[73] Assignee: R-Amtech International, Inc., Bellevue, Wash.

[21] Appl. No.: 09/349,153

[22] Filed: Jul. 8, 1999

[30] Foreign Application Priority Data

Jul. 17, 1998 [RU] Russian Federation ..... 98113060
Nov. 13, 1998 [RU] Russian Federation ..... 98120263

[51] Int. Cl.[7] ..... A62C 2/00; A62C 35/00

[52] U.S. Cl. ..... 169/46; 169/12; 169/54

[58] Field of Search ..... 169/44, 46, 5, 169/11, 12, 54, 30, 71, 84; 239/128, 590, 590.3; 252/2, 4, 5

[56] References Cited

U.S. PATENT DOCUMENTS

| | | | |
|---|---|---|---|
| 4,226,727 | 10/1980 | Tarpley, Jr. et al. | 169/47 |
| 5,425,426 | 6/1995 | Baratov et al. | 169/46 |
| 5,613,562 | 3/1997 | Galbraith et al. | 169/12 |
| 5,865,257 | 2/1999 | Kozyrev et al. | 169/46 |

FOREIGN PATENT DOCUMENTS

| | | |
|---|---|---|
| 9733653 | 9/1997 | WIPO . |
| 9802211 | 1/1998 | WIPO . |

*Primary Examiner*—Andres Kashnikow
*Assistant Examiner*—Sean P. O'Hanlon
*Attorney, Agent, or Firm*—Rothwell, Figg, Ernst & Manbeck, PC

[57] ABSTRACT

The invention relates to the firefighting technology. The method and system according to the invention provide environmentally safe and efficient fire extinguishing by introducing into a space that is being protected a vapor, gas, and aerosol mixture that is preliminarily oxidized and cooled and that contains a solid phase with particles of 1 to 2 $\mu$m, which is formed upon combustion of a pyrotechnic composition, and performing post-oxidation of the combustion products in a bed of a sorbent with an oxygen-containing oxidizer. A vapor and gas mixture is simultaneously introduced into the space that is being protected. The vapor and gas mixture is formed by desorption from the surface of a solid coolant that is saturated with a coolant as a result of indirect heat exchange with the products of combustion of the pyrotechnic composition. The oxygen-containing oxidizer may be in the form of potassium nitrate. A system is a casing with a discharge port, which accommodates a combustor that is thermally insulated from the casing walls and contains a pyrotechnic composition, an igniter, and a sorbent with an oxygen-containing oxidizer, a cooling unit located over the combustor, which is insulated against direct contact with the products of combustion of the pyrotechnic composition and has at least two coaxially extending shells that are filled with a coolant. Partition walls are provided over the shells, and a space defined between them is filled with a filtering sorbent.

19 Claims, 3 Drawing Sheets

METHOD AND APPARATUS FOR FIRE EXTINGUISHING

FIELD OF THE INVENTION

The invention relates to the firefighting technology and, more specifically, it deals with firefighting with the use of devices that have pyrotechnic compositions that are capable of releasing a fire extinguishing gas and aerosol mixture as a result of thermal decomposition that occurs when they are burned.

The invention may be effectively used for extinguishing fires in various facilities and systems, such as:

warehouses, garages, and book storage facilities;

offices and workshop spaces;

engine and baggage compartments of various vehicles;

ventilation systems of industrial plants, hotels, etc.

The method and apparatus for firefighting not only can assure the effective fire safety for products of human activities, but they are also capable of supporting life of human beings and animals and protect the environment in an emergency situation resulting from fire.

STATE OF THE ART

Conventional firefighting methods that are based on providing within a space being protected a desired concentration of an inert medium (nitrogen, carbon oxide, and water vapor) cannot be always used efficiently. Their application in a majority of cases requires personnel involvement, and after their employment, a further use of various items (books, computers, etc.) becomes practically impossible.

In view of the above, firefighting methods that involve the use of gas and aerosol generating devices have come into extensive use. Fire extinguishing with the application of such apparatuses involves causing remote ignition of a gas and aerosol release agent within a space that is being protected, the agent releasing a very fine aerosol (1 to 5 $\mu$m) as result of thermal decomposition during combustion, which has the extinguishing effect on the flame in the seat of fire.

It is known to perform firefighting with application of fire extinguishing compositions (Patent RU No. 2019214, C1. A 61 C2/00, published 09.15.94) by forming in a space that is being protected a medium that does not sustain combustion, which consists mainly of nitrogen (74.7 mol %) and carbon oxide (1.6 mol %). To enhance efficiency of the extinguishing effect, the flame is also subjected to the inhibiting effect of the surface of the condensed phase of an aerosol that consists of KCl and $K_2CO_3$, in quantities of 0.17 and 1.43 mass %, respectively. This aerosol and gases are formed by burning a charge of a solid fuel.

The prior art method has a number of disadvantages:

a sufficiently large charge of a solid fuel (over 1.2 kg) is needed to achieve the fire extinguishing effect;

low yield of aerosol;

high temperature of burning of the solid fuel charge (over 1,700° K);

complicated inert gas (nitrogen) cooling system and a high inert gas consumption rate (2.2 kg/s).

Known in the art is a method of firefighting (Patent EP No. 0561035, C1. A 62 D 1/00,A 62 D 1/06,"EP '035") that involves burning, within a space being protected, a charge of a pyrotechnic composition containing 40 to 50 wt % of potassium perchlorate, 9 to 12 wt % of epoxy resin, 10 to 44 wt % of potassium chloride, and up to 4 wt % of magnesium powder. Another composition can also be used, which contains 70 to 80 wt % of potassium nitrate, 19 to 23 wt % of epoxy resin, and 2 to 4 wt % of magnesium or aluminum powder.

This method has a number of disadvantages:

the gaseous phase that is formed upon the burning of the above-mentioned compositions contains HCl and CO that cause suffocation and death of living organisms;

the aerosol that is formed upon the burning of the compositions contains an alkali (KOH), which, apart from the harmful effect on living organisms, is also harmful for the environment and causes corrosion of instruments and other hardware that is within the range of activity of the aerosol;

the aerosol consists of particles of about 1 $\mu$m in diameter or finer, which are harmful to the respiratory organs; they cause irritation of the mucous membrane and invade the blood vessels without practically being evacuated from the body;

a high temperature of the combustion products formed from these compositions requires that the gas and aerosol mixture be cooled, and the use of water, carbon dioxide, and aqueous solutions of sodium and potassium salts for cooling may result in corrosion of the device during storage, thus lowering reliability and compromising durability of the fire extinguishing apparatus.

Known in the art are a method and an apparatus for preparing a fire extinguishing mixture (PCT/RU 92/00071, WO 92/17244, C1. A 62 D 1/00, "PCT '071"). The method involves burning a pyrotechnic composition that contains 55 to 90 mass % of an alkali metal nitrate or perchlorate and a fuel and binder in a quantity of 10 to 45 mass %. The fuel and binder is iditol or ballistite powder. Charges of the pyrotechnic composition are placed in a cylindrical shell casing that has an igniter for the charge.

This method has a number of disadvantages:

a high temperature of the combustion products (about 1200° C.);

the apparatus for carrying out the process has limited capabilities in controlling the temperature of the combustion products, hence, a flames or sparks are formed downstream of the discharge port, which may set the surrounding objects on fire.

Another method and apparatus for fire extinguishing are known in the art (Patent RU No. 2,008,045, C1. A 62 C 3/00, published 02.28.94, "RU '045"). The method involves introducing a fire retardant into a space that is being protected. This retardant is obtained either by burning a pyrotechnic charge or by burning a pyrotechnic charge and displacing a cooling fluid by the resulting aerosol, with subsequent spraying of the aerosol and fluid. The cooling fluid may also function as a fire retardant.

The method and apparatus have a number of disadvantages:

a high temperature of burning of the compositions used (1757 to 2723° K);

high toxicity of the resulting gas and aerosol fire retardants because they contain high concentrations of chlorine compounds ($KClO_4$), chromium compounds ($K_2Cr_2O_7$), and phosphorus compounds ($K_5P_3O_7$);

the use of a complex cooling system that consists of an ablation lining, an air jet nozzle, and a fluid coolant device.

The closest prior art method for fire extinguishing (Patent RU No. 2,087,170, C1. A 62 C 13/22, published 08.20.97, "RU '170") involves introducing into a space that is being protected preliminarily post-oxidized and cooled products of combustion of a solid fuel. The post-oxidation process is conducted in a jet flow, with oxygen from the surrounding air or another gaseous oxidizer that is fed to a generator under pressure being used as an oxidizer. The combustion products are cooled in a non-contact way, by using a liquid coolant from an available cooling system, e.g., from an internal combustion engine cooling system.

An apparatus for carrying out this method (Patent RU No. 2,097,079, C1. A 62 C 13/22, published 11.27.97, "RU '079") has a casing that accommodates a combustor, a solid fuel aerosol-forming composition secured within the combustor, an igniter for the solid fuel, and a discharge nozzle. The casing is divided by a transverse partition wall having at least one opening, at least one pipe is attached to the partition wall to extend coaxially with the discharge nozzle, the space defined between the pipe and the inside surface of the casing being filled with a coolant, the casing having ports located between the transverse partition wall and the end face of the combustor, and the discharge nozzle of the combustor being made as a jet nozzle and received in the partition wall to define a space with respect to the pipe that has its open end communicating with the atmosphere. A swirl blade is located in the space between the jet nozzle and the pipe.

The prior art method and apparatus for fire extinguishing have a number of disadvantages:

a limited application of this fire extinguishing method only for a narrow range of solid fuel compositions for which the process of post-oxidation of the combustion products at the initial stage of the burning depends but only slightly on the volume of the jet air oxygen. This may be explained by the fact that the volume of the jet air is wholly dependent on the outside air pressure, which fluctuates, and on the discharge velocity of the gas and aerosol flow, which, in turn, depends on the pressure in the casing of the apparatus. There are certain pressure limitations that are imposed based on the safety criteria for such devices. If the pressure inside the device is twice as high as the atmospheric pressure, the device is regarded as a pressure vessel, and the design safety requirements become more stringent;

limited capabilities in obtaining a larger mass fraction of the solid phase of the gas and aerosol extinguishing mixture. This is due to the fact that complete post-oxidation of the combustion products results in an increase in the fraction of inert gases. However, the quantity of these gases is not sufficient for creating a medium that does not sustain the burning within the space that is being protected. At the same time, a surplus of an oxidizer that is supplied into the jet space results in a decrease in the amount of the basic fire extinguishing component or the solid phase of the gas and aerosol mixture caused by its chemical reaction, thus lowering the fire extinguishing capacity.

SUMMARY OF THE INVENTION

The problem underlying the invention is to provide a method and an apparatus for fire extinguishing which are applicable with a wide range of pyrotechnic compositions, ensure a high fire extinguishing efficiency and reduce the environmental impact.

This problem is solved by a method comprising the following steps a) ignition of a pyrotechnic composition to form a gas and aerosol mixture consisting of a gaseous phase and a solid phase;

b) passing the gas and aerosol mixture through a bed of a first sorbent comprising an oxygen-containing oxidizer for post-oxidation, c) cooling the gas and aerosol mixture by heat exchange with coolant means, d) passing the cooled gas and aerosol mixture through a filtering sorbent into a space that is being protected.

When the hot gas and aerosol mixture passes through bed of the first sorbent, the oxygen-containing oxidizer that is adsorbed on the surface layer of the sorbent decomposes. The resulting oxygen reacts with the gas and aerosol and with incompletely oxidized products. The basic post-oxidation reactions are as follows:

$$2CO+O_2 \rightarrow 2CO_2$$

$$2H_2+O_2 \rightarrow 2H_2O$$

$$2NH_3+1.5O_2 \rightarrow N_2+3\ H_2O$$

$$CH_4+O_2 \rightarrow CO_2+2H_2O$$

Therefore, harmful products of incomplete oxidation are chemically removed from the combustion products in the quantities that are proportional to the quantity of the oxygen-containing oxidizer applied to the sorbent surface. Therefore any pyrotechnic compositions that release combustion products containing very fine aerosol particles can be used in the method of the present invention.

The oxygen-containing oxidizer is preferably an alkali metal nitrate

The resulting gas and aerosol mixture is then cooled through heat exchange with a solid coolant. The cooled gas and aerosol mixture is filtered by the filtering sorbent such that mostly particles with a desired size are fed into the space that is being protected. The mass fraction of particles in the solid phase of the gas and aerosol mixture passed into the space having a size of 1 to 2 $\mu$m is preferably at least 70%. The filtering sorbent is selected from the group of the following substances: zeolites, aluminum silicates, silica gels, activated charcoal, or mixtures thereof.

By the reduction of the temperature of the combustion products flames or sparks are prevented from entering into the space being protected.

The gas and aerosol mixture can be cooled by indirect heat exchange with coolant means comprising a solid sorbent saturated with a liquid, whereby a vapor and gas mixture is desorbed from the coolant means by the heat of the gas and aerosol mixture, the vapor and gas mixture being passed together with the cooled gas and aerosol mixture through a filtering sorbent into a space that is being protected.

The solid sorbent is preferably made of substances selected from the group of zeolites, aluminum silicates, silica gels, activated charcoal, or mixtures thereof. These substances, which have a porous structure and extended surface, are capable of adsorbing various chemical compounds including water, which can be chosen to function as a coolant.

Owing to indirect heat exchange between the hot gas and aerosol mixture and the solid sorbent that is saturated with a coolant, heat is spent for heating the sorbent and for desorption of the coolant from the sorbent surface, thus resulting in the gas and aerosol mixture being cooled and additional vapor and gas mixture being formed. The resulting vapor and gas mixture passes simultaneously with the precooled gas and aerosol mixture through the bed of the filtering sorbent. The gas and aerosol mixture and the vapor and gas mixture are additionally chemically purified within the bed of the filtering sorbent, and the aerosol is filtered to obtain particles of 1 to 2 $\mu$m.

Therefore, a highly active vapor, gas, and aerosol mixture is formed, which consists of a gas phase, solid phase, and vapor and gas phase of the desorbed coolant, which are discharged to the space that is being protected.

To enhance the effect of cooling of the gas and aerosol mixture and to achieve the quantitative increase in the fraction of the highly-active solid phase of the gas and aerosol mixture, compounds of alkali metals, e.g., $KHCO_3$, $K_2CO_3$, and the like may also be applied to the surface of the filtering sorbent. By reacting with the hot aerosol mixture, these compounds remove its heat to be used for heating, desorption, and dispersion. As a result of the chemical reactions and physical dispersion, a highly dispersed solid phase of the gas and aerosol mixture is formed.

The vapor, gas, and aerosol mixture that has a low temperature of 300 to 350° C. is admitted, without sparks and flames, to the fire zone where it cools the flame through heat removal and deactivates active atoms and radicals of the flame on the surface of the highly active solid aerosol particles. The fire is extinguished in a few seconds, without having a harmful effect on living organisms, the environment, instruments, hardware, and other equipment.

It is also possible to cool the gas and aerosol mixture by heat exchange with a metallic coolant .

The method of the present invention can be carried out by an apparatus for fire extinguishing comprising a casing having a discharge port at a downstream end thereof, combustion means accommodated in the casing and containing a pyrotechnic composition and ignition means for ignition of the pyrotechnic composition, two first permeable partition walls arranged in axially spaced relationship in the combustion means downstream of the pyrotechnic composition and the ignition means, a sorbent with an oxygen-containing oxidizer being arranged between the two first permeable partition walls, a cooling unit arranged downstream of the two first permeable partition walls and comprising at least one axially extending through passage, and two second permeable partition walls arranged in axially spaced relationship in the casing between the cooling unit and the discharge port, the space between the second permeable partition walls being filled with a filtering sorbent.

The cooling unit can be formed by at least two coaxially extending cylindrical cooling means having a closed upstream bottom and an openings at the downstream end thereof, the inner space of the cooling means being filled with a solid sorbent saturated with liquid.

The outer wall of one of the cooling means can contact the inner wall of the casing.

Preferably the inner and the outer walls are formed of a metal having a melting point that is above the combustion temperature of the pyrotechnic composition.

In a preferred embodiment the inner and outer walls are corrugated.

In another preferred embodiment of the invention the cooling unit is formed by at least two axially extending metallic thick-walled tubes, which are are coaxially arranged or arranged side by side.

It is also possible to form the cooling unit by a metallic block in which axially extending through passages are formed.

The discharge port may be made as a plate with openings extending in parallel with each other.

BRIEF DESCRIPTION OF THE DRAWINGS

The invention will now be described in greater detail with reference to the accompanying drawings, wherein.

PREFERRED EMBODIMENTS FOR REALIZATION OF THE METHOD AND APPARATUS ACCORDING TO THE INVENTION

Figure 1:
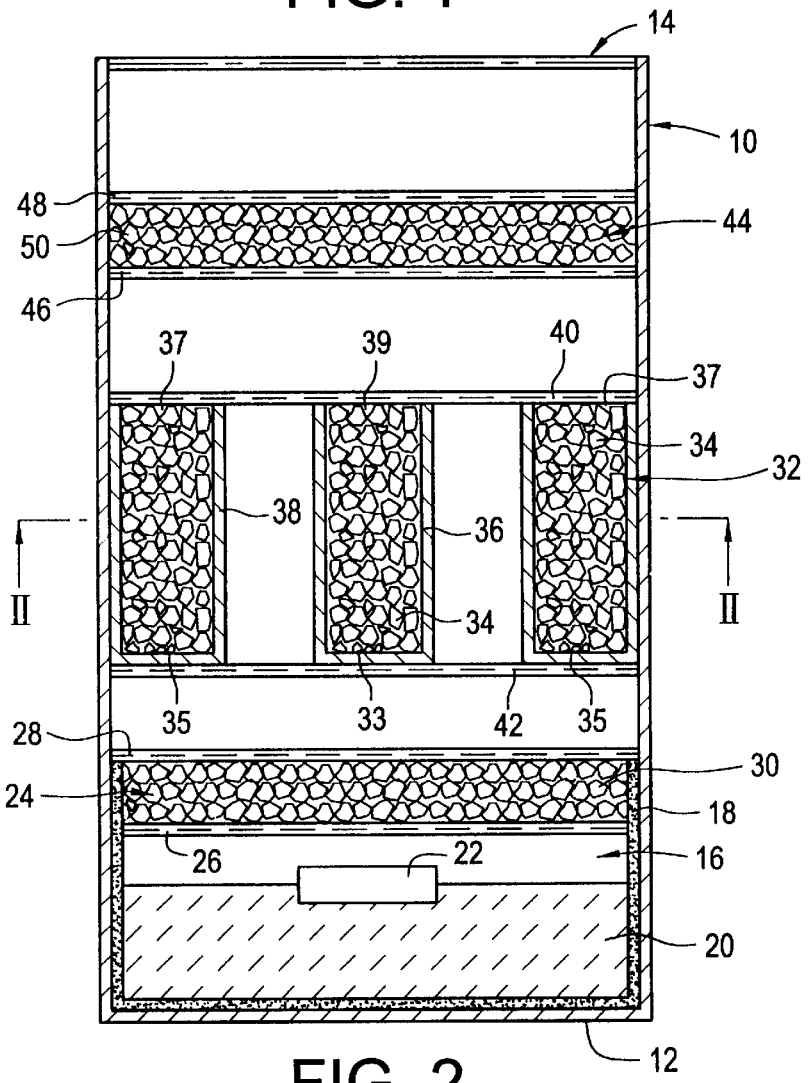
FIG. 1 shows a longitudinal cross section of a first embodiment of an apparatus for fire extinguishing according to the present invention.
Figure 2:
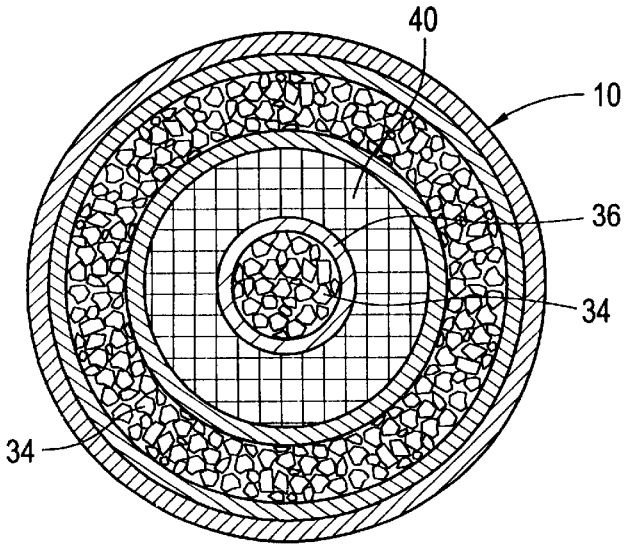
FIG. 2 shows the cross section II—II of FIG. 1.

The first embodiment of an apparatus for fire extinguishing according to the present invention shown in FIGS. 1 and 2 comprises a cylindrical metal casing 10 with an inner diameter of 48 mm having a closed upstream end 12 and a discharge port 14 at the downstream end. Adjacent to the upstream end 12 of the casing 10 a cylindrical combustion camber 16 is arranged within the casing 10. The combustion chamber 16 is thermally insulated from the casing 10 by means of fiberglass plastic 18. A pyrotechnic composition 20 formed as a cylindrical charge is accommodated in the upstream portion of the combustor 16. In order to extinguish burning gasoline in a protected space of 2.5 $m^3$, 100 g of pyrotechnic composition No. 4 as shown in Table 1 is used. On the upper surface of the pyrotechnic composition 20 a recess is formed in the central portion in which a standard 1-g igniter 22 is accommodated.

A sorbent with an oxygen-containing oxidizer is arranged between two grids 26, 28 with 2.0×2.0-mm mesh and is arranged approximately 25 mm above the pyrotechnic composition 20. The sorbent with an oxygen-containing oxidizer is prepared in the following manner. 7.5 g of zeolite 30 with the average particle size of 3.6 mm is pretreated with a 7% solution of potassium nitrate during one hour and was dried to a constant weight at a temperature of >75° C.

A cooling unit 32 is placed at a distance of 5 mm over the top partition wall 28. The cooling unit 32 is 125 mm long and comprises two coaxially extending metal cylinders 36, 38. The outer diameter of the inner cylinder 36 is 24 mm whereas the inner diameter of the outer cylinder 38 is 34 mm. The space between the outer cylinder 38 and the inner wall of the casing 10 and the inner space of the inner cylinder are provided with bottoms 33, 35 at their upstream ends 37, 39. The cylinders 36, 38 are filled with 110 g of zeolite 34 with an average particle size of 1.6 mm, which were preliminarily saturated with water at 33 mass %. The cylinders 36, 38 with the zeolite 34 are fixed in the casing 10 by two grids 40, 41 having 1.2 mm-diameter ports.

Filtering sorbent 44 is fixed in the casing 10 by two grids 46, 48 at a distance of 7mm from the cooling unit 32. The grids 46, 48 are provided with ports having a diameter of 1.6 mm. The filtering sorbent consisting of 15 g of zeolite 50 with the average particle size of 2.6 mm was pretreated with a 50% aqueous suspension of $KHCO_3$ during 15 minutes and dried to a constant weight.

The first embodiment of the apparatus shown in FIGS. 1 and 2 functions in the following manner. In the event of a fire, igniter 22 is activated to ignite pyrotechnic composition 20 that is accommodated in combustion chamber 16 insulated from casing 10 by glass fiber plastic 18. When pyrotechnic composition 20 is burned, a gas and aerosol mixture is formed. This mixture passes through sorbent with oxygen-containing oxidizer 30 that is located in the combustion chamber 16 between grids 26, 28. The oxygen-containing oxidizer 30 decomposes to perform post-oxidation of the gaseous phase of the products of combustion of the pyrotechnic composition 20. The gas and aerosol mixture then goes to cooling unit 32 that consists of coaxially extending cylinders 36, 38 which accommodate the solid sorbent 34 saturated with water. As a result of indirect heat exchange through the cylinder walls between the combustion products and the solid sorbent 34 saturated with water, the combustion products are cooled through heating of the solid sorbent and desorption of the water at its surface. A vapor and gas mixture resulting from desorption passes simultaneously with the gas and aerosol mixture through the grid 40 of cooling unit 32 and through filtering sorbent 50 that is located between two grids 46, 48. The filtered and purified vapor, gas, and aerosol mixture, comprising a solid phase of 70 g with an average particle size of 1–2 mm, is discharged through discharge port 14 into the flame zone of the space that is being protected to extinguish the fire. The fire is extinguished within 15 seconds. The temperature at a distance of 100 mm from the discharge port 14 and at the walls of the casing 10 at the fifteenth second of operation of the apparatus, which is measured by means of thermocouples, is 300° C. and 50° C., respectively. The temperature at a distance of 200 mm from the discharge port 14 is 110° C. There are no flames or sparks.

Pyrotechnic Compositions that were Used for Assessing the Efficiency of the Method and Apparatus for Fire Extinguishing According to the Invention

TABLE 1

| Composition | Oxidizers | % by mass | Fuel/binder | % by mass | Fuel | % by mass |
|---|---|---|---|---|---|---|
| 1 | $KNO_3$ | 85 | Phenol formaldehyde resin | 15 | None | — |
| 2 | $KClO_4$ | 60 | Epoxy resin | 40 | None | — |
| 3 | $KNO_3$ | 40 | Ballistite powder | 60 | None | — |
| 4 | $KNO_3$ | 70 | Phenol fomaldehyde resin | 11 | Dicyaneamide | 19 |
| 5 | $KNO_3$ | 55 | Phenol formaldehyde resin | 10 | Dicyaneamide | 35 |
| 6 | $NH_4ClO_4KNO_3$ | 2060 | Epoxy resin | 10 | Dicyaneamide | 10 |
| 7 | $KNO_3$ | 45 | Ballistite powder | 55 | None | — |

Figure 3:
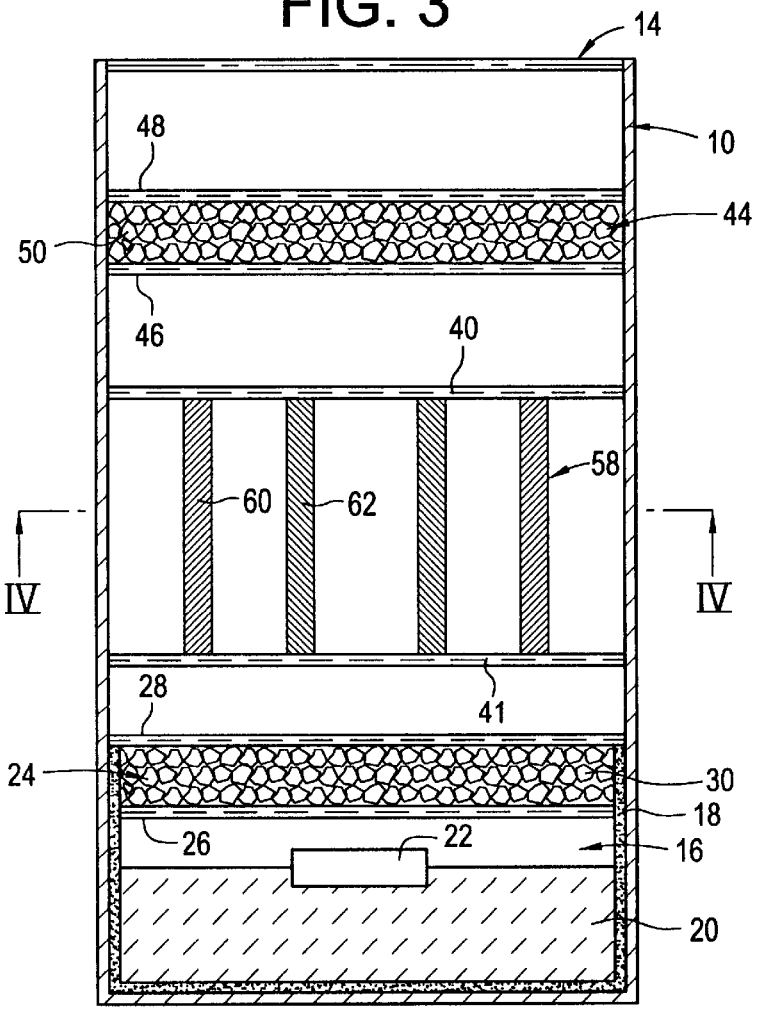
FIG. 3 shows a longitudinal cross section of a second embodiment of an apparatus for fire extinguishing according to the present invention.
Figure 4:
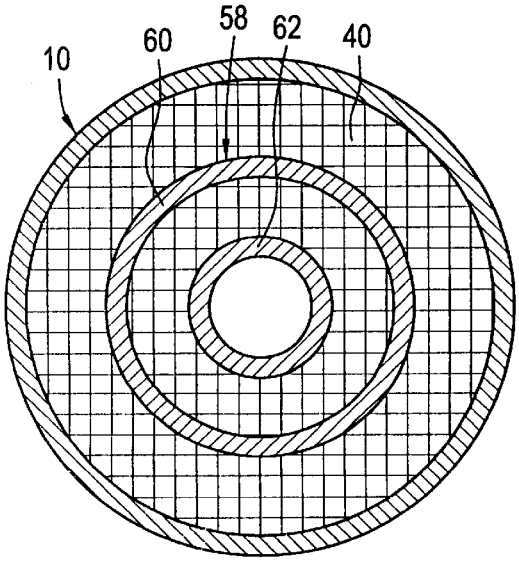
FIG. 4 shows the cross section IV—IV of FIG. 3.

The second embodiment of the apparatus of the present invention shown in FIGS. 3 and 4 differs from the first embodiment of FIGS. 1 and 2 in that a cooling unit 58 is used instead of cooling unit 32.

The cooling unit 58 is made of two coaxially thick-walled steel tubes 60, 62,the walls having a thickness of 5 mm, the inner tube 62 having an outside diameter of 24 mm, and the outer tube 60 having an outside diameter of 36 mm. The steel tubes are supported in the casing 10 by grids 41, 40 having ports with a diameter of 1.6 mm.

Figure 5:
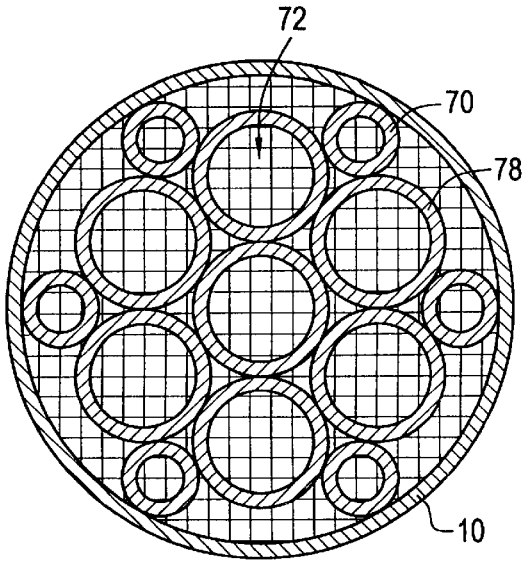
FIG. 5 shows a cross section, similar to FIG. 4, of a third embodiment of an apparatus for fire extinguishing according to the present invention.

The third embodiment of the apparatus of the present invention shown in FIG. 5 differs from the second embodiment of FIGS. 3 and 4 in that a cooling unit 72 is used instead of cooling unit 58. The cooling unit 72 comprises a plurality of steel tubes 70 which are arranged side-by-side.

Figure 6:
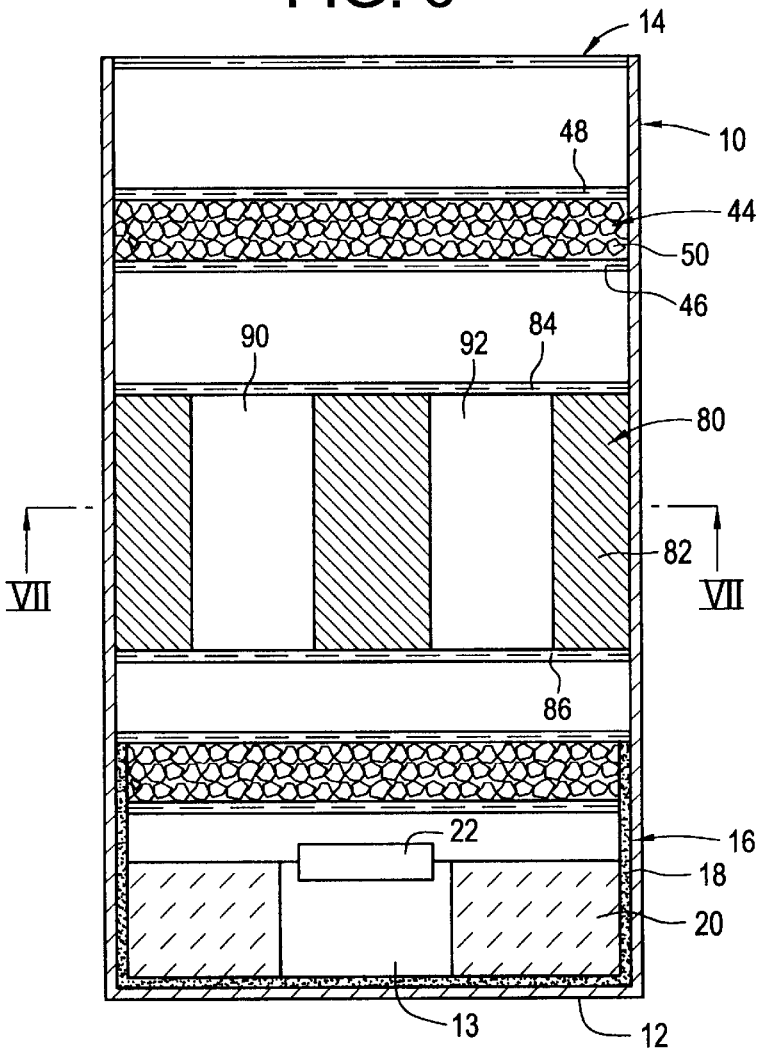
FIG. 6 shows a longitudinal cross section of a fourth embodiment of an apparatus for fire extinguishing according to the present invention.
Figure 7:
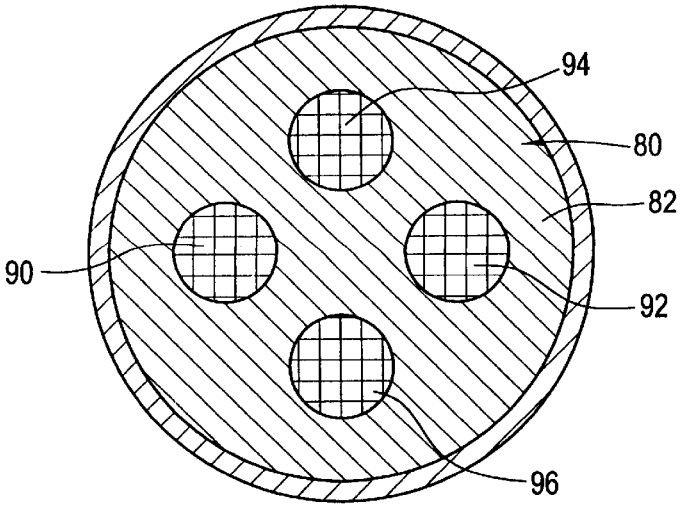
FIG. 7 shows the cross section VII—VII of FIG. 6.
Figure 3:
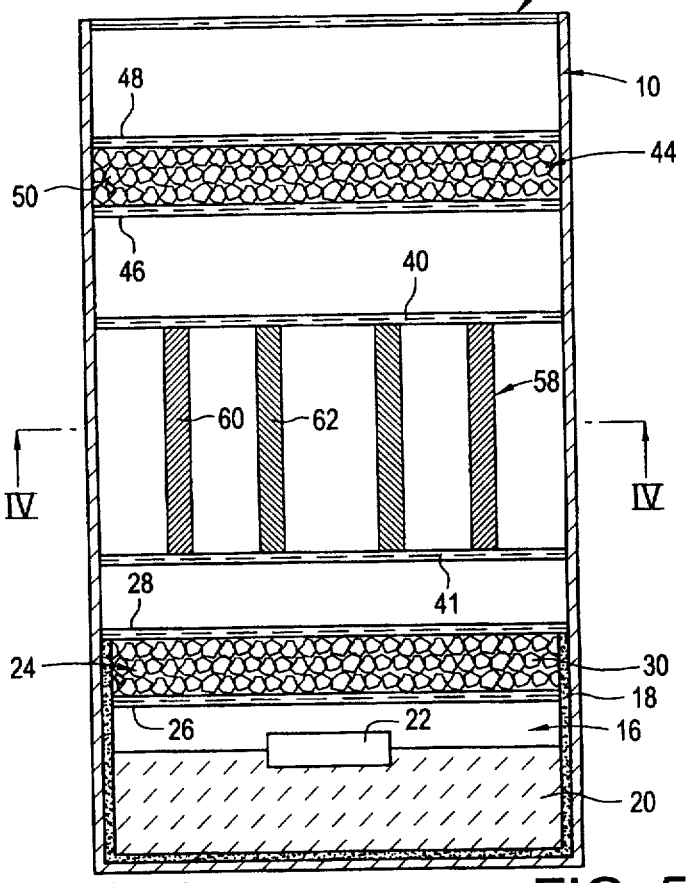
Figure 4:
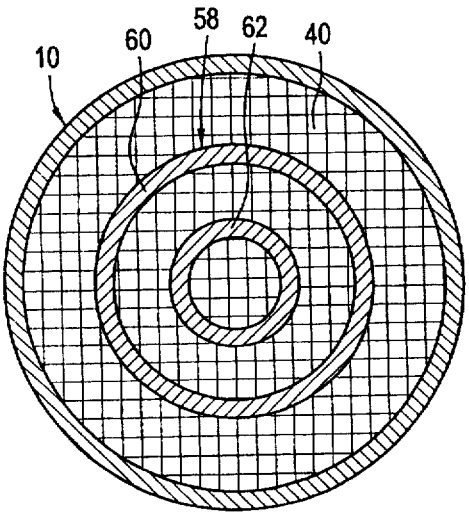
Figure 5:
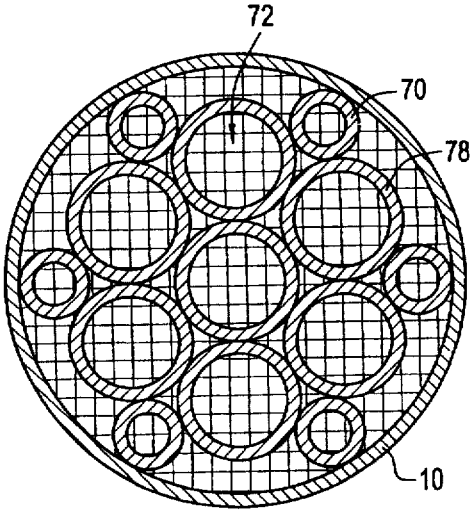

The fourth embodiment of the apparatus of the present invention shown in FIGS. 6 and 7 differs from the second embodiment of FIG. 3 and 4 in that a cooling unit 80 is used instead of cooling unit 58. The cooling unit 80 comprises a cylindrical aluminum block 82,the outer surface of which contacts the inner Wall of the casing 10. The block 82 is fixed in the casing 10 by two grids 84, 86. Logitudinal through passages 90, 92, 94, 96 having a diameter of 8 mm are provided in the block 82.

In the apparatus for fire extinguishing the pyrotechnical composition 20 is optionally provided with one channel 13 or several channels 13 along the perimeter. FIG. 6 shows the pyrotechnical composition 20 wherein channel 13 is arranged centrally.

In the embodiments of FIGS. 3 to 7 the thickness of the walls 60, 62 was chosen by considering heating value of the pyrotechnic composition and heat-absorbing capacity of the wall material. As regards the pyrotechnic compositions in question, their heating value was in the range of about 800–1000 kcal/kg. As regards the material of the block or the casing walls, they should be made of steel, aluminum, copper or different alloys. By knowing the mass of the pyrotechnic composition, it was easy to calculate the amount of the generated heat in each particular case, and by using experimental data one could determine the burning temperature of the composition. By knowing the characteristics, and also by determining the requested temperature when leaving the device, and by taking into consideration the importance of the heat capacity of the wall material, one could determine the necessary thickness of the walls.

When gasoline was set on fire, the heat of the flames activated the igniter 22 which ignited the pyrotechnic composition 20. The burning of the pyrotechnic composition 20 resulted in an aerosol mixture being formed. This mixture passed through the sorbent containing an oxygen-containing oxidizer 30 that decomposed to perform post-oxidation of the pyrotechnic composition combustion products. The gas and aerosol mixture then went to the cooling unit and, as a result of indirect heat exchange between the combustion products and the metallic means (cylinders, tubes) of the cooling unit the combustion products were cooled as heat was spent for heating the casing. The cooled gas and aerosol mixture passed through the filtering sorbent 50. The filtered and purified gas and aerosol mixture was discharged through the discharge port 14 into the flame zone of the space that was being protected and extinguished the fire in 17 seconds.

The temperature at a distance of 100 mm from the discharge port 14 and at the walls of the casing 10 at the seventeenth second of operation of the apparatus, which was measured by means of thermocouples, was 328° C. and 63° C., respectively. The temperature at a distance of 200 mm from the discharge port 14 was 115° C. There were no flames or sparks.

The physical and chemical analysis of particles of the vapor, gas, and aerosol mixture showed that the mass fraction of particles of 1.2 $\mu$m was 72%, the mass fraction of particles larger than 2 $\mu$m was 10%, and the balance were particles of a size smaller than 1 $\mu$m. The main components of the solid phase were $KHCO_3$, $NH_4HCO_3$, and $K_2CO_3$.

The test results for the other compositions given in Table 1 are shown in Table 2. It can be seen from the data given in Table 2 that application of the method and apparatus for fire extinguishing according to the invention allows a wide range of pyrotechnic compositions to be used for their implementation, with the low temperatures at the outlet of the apparatus and at the casing, without flames or sparks. The mass fraction of components of the solid phase of the highly active gas and aerosol mixture, which does not have an adverse environmental impact, is 70% and even greater.

TABLE 2

| Composition No. from Table 1 | Apparatus | Basic parameters Casing temperature, ° C. | Discharge temperature, ° C. | Fire extinguishing concentration, g/m$^3$ | Mass fraction of particles of 1–2 $\mu$m, % | Other parameters Remarks |
|---|---|---|---|---|---|---|
| 4 | RU patent 2097079 | 150 | 720 | 50 | 64 | Sparks and flames within up to 20 cm from the discharge port |
| 4 | This invention acc. to FIG. 1 | 60 | 300 | 40 | 72 | No sparks or flames |
| 1 | This invention acc. to FIG. 1 | 63 | 328 | 40 | 70 | No sparks or flames |
| 2 | This invention acc. to FIG. 1 | 62 | 325 | 52 | 73 | No sparks or flames |
| 3 | This invention acc. to FIG. 1 | 56 | 306 | 42 | 75 | No sparks or flames |
| 5 | This invention acc. to FIG. 1 | 61 | 316 | 76 | 71 | No sparks or flames |
| 6 | This invention acc. to FIG. 1 | 62 | 320 | 70 | 72 | No sparks or flames |
| 7 | This invention acc. to FIG. 1 | 58 | 295 | 45 | 74 | No sparks or flames |
| 4 | This invention acc. to FIG. 2 | 63 | 328 | 40 | 72 | No sparks or flames |
| 4 | This invention acc. to FIG. 3 | 59 | 305 | 40 | 70 | No sparks or flames |

Industrial Applicability

The method and apparatus for fire extinguishing allow fires caused by various combustible substances to be efficiently extinguished in enclosed facilities and devices such as:

warehouses, garages, and book storage facilities;

offices, workshop spaces, animal and poultry breeding spaces;

motor and baggage compartments of various vehicles;

ventilation systems of industrial plants, hotels, etc.

The method and system according to the invention have the following advantages: simplicity and reliability of maintenance, safety and durability in operation, high fire extinguishing efficiency, low material usage, and a wide range of raw materials that can be used for manufacturing the components. The fire extinguishing vapor, gas, and aerosol mixture has a low temperature and escapes from the discharge port of the fire extinguishing system without flames or sparks, so it does not have a harmful effect on human beings, living organisms, the environment, precision instruments, and devices.

What is claimed is:

1. A method for fire extinguishing, comprising the following steps a) ignition of a pyrotechnic composition to form a gas and aerosol mixture consisting of a gaseous phase and a solid aerosol phase;

b) passing said gas and aerosol mixture through a bed of a sorbent comprising an oxygen-containing oxidizer for post-oxidation, c) cooling said gas and aerosol mixture by heat exchange with coolant means, including indirect heat exchange of said gas and aerosol mixture with a solid sorbent;

d) passing said cooled gas and aerosol mixture through a filtering sorbent into a space that is being protected.

2. Method according to claim 1, wherein said gas and aerosol mixture is cooled by heat exchange with coolant means comprising a solid sorbent saturated with a liquid, whereby a vapor and gas mixture is desorbed from said coolant means by heat of said gas and aerosol mixture, said vapor and gas mixture being passed together with said cooled gas and aerosol mixture through a filtering sorbent into a space that is being protected.

3. The method of claim 2, wherein said solid sorbent is made of substances selected from the group of zeolites, aluminum silicates, silica gels, activated charcoal, or a mixture thereof.

4. The method of claim 2, wherein said liquid is water.

5. The method of claim 2, wherein said filtering sorbent is selected from the group of the following substances: zeolites, aluminum silicates, silica gels, activated charcoal, or a mixture thereof.

6. The method of claim 5, wherein said filtering sorbent additionally contains substances selected from the group of alkali metal carbonates.

7. The method of claim 1, wherein said gas and aerosol mixture is cooled by heat exchange with a metallic coolant.

8. The method of claim 1, wherein the partial mass fraction of particles in said solid phase of said gas and aerosol mixture passed into said space has a size of 1 to 2 $\mu$m and is at least 70%.

9. The method of claim 1, wherein said oxygen-containing oxidizer is an alkali metal nitrate.

10. An apparatus for fire extinguishing comprising a casing having a discharge port at a downstream end thereof, a combustion chamber accommodated in said casing, the combustion chamber containing a pyrotechnic composition and ignition means for ignition of said pyrotechnic composition, two first grids arranged in spaced relationship downstream of said pyrotechnic composition and said ignition means, a sorbent with an oxygen-containing oxidizer being arranged between said two first grids, a cooling unit arranged downstream of said two first grids, said cooling unit including two second grids arranged in spaced relationship, metallic means through which at least one through-passage extends being arranged between said two second grids, two third grids arranged in said casing in spaced relationship between said cooling unit and said discharge port, a filtering sorbent being filled between said two third grids.

11. The apparatus of claim 10, wherein in said cooling unit said metallic means is formed by at least two coaxially arranged cylinders having closed bottoms and openings at downstream ends thereof, said cylinders being filled with a solid sorbent saturated with liquid.

12. The apparatus of claim 11, wherein an outer wall of said cylinders are corrugated.

13. The apparatus of claim 11, wherein an outer wall of one of said cylinders contacts an inner wall of said casing.

14. The apparatus of claim 10, wherein said metallic means of said cooling unit are formed by at least two metallic thick-walled tubes.

15. The apparatus of claim 14, wherein said metallic thick-walled tubes are arranged side by side.

16. The apparatus of claim 10, wherein said metallic means of said cooling unit are formed as a block with through passages formed therein.

17. The apparatus of claim 10, wherein metallic means of said cooling unit are formed of a metal having a melting point that is above the melting temperature of said pyrotechnic composition.

18. The apparatus of claim 10, wherein said filtering sorbent is selected from the group of the following substances: zeolites, aluminum silicates, silica gels, activated charcoal, or a mixture thereof.

19. The apparatus of claim 18, wherein said filtering sorbent additionally contains a substance selected from the group of alkali metal carbonates.

* * * * *

UNITED STATES PATENT AND TRADEMARK OFFICE

CERTIFICATE OF CORRECTION

PATENT NO. : 6,116,348
DATED : September 12, 2000
INVENTOR(S) : Nikolay V. Drakin It is certified that error appears in the above-identified patent and that said Letters Patent is hereby corrected as shown below:

In the Drawings:
Sheet 2 of 3 of the drawings should be replaced with the attached sheet containing corrected FIG. 4.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*